US007425115B2

(12) United States Patent
Johnson et al.

(10) Patent No.: US 7,425,115 B2
(45) Date of Patent: Sep. 16, 2008

(54) THERMAL TURBOMACHINE

(75) Inventors: Nicolas Campino Johnson, Baden (CH); Matthias Hoebel, Windisch (CH); Jonas Hurter, Baden (CH); Christoph Niederberger, Wiesenberg (CH)

(73) Assignee: Alstom Technology Ltd, Baden (CH)

( * ) Notice: Subject to any disclaimer, the term of this patent is extended or adjusted under 35 U.S.C. 154(b) by 393 days.

(21) Appl. No.: 11/249,625

(22) Filed: Oct. 14, 2005

(65) Prior Publication Data

US 2006/0062664 A1 Mar. 23, 2006

Related U.S. Application Data

(63) Continuation of application No. PCT/EP2004/050512, filed on Apr. 13, 2004.

(30) Foreign Application Priority Data

Apr. 14, 2003 (CH) ..... 0674/03

(51) Int. Cl.
*F01D 5/20* (2006.01)

(52) U.S. Cl. ..... 415/173.4; 415/173.6; 415/174.4; 415/200; 416/224; 416/229 A; 416/241 R

(58) Field of Classification Search ..... 415/173.4, 415/173.6, 174.4, 200; 416/224, 229 A, 416/241 R, 241 B; 427/181, 182, 237, 252, 427/454; 428/469, 472, 632
See application file for complete search history.

(56) References Cited

U.S. PATENT DOCUMENTS

| | | | | |
|---|---|---|---|---|
| 3,199,836 | A | 8/1965 | Moyer | |
| 4,390,320 | A | 6/1983 | Eiswerth | |
| 4,589,823 | A | 5/1986 | Koffel | |
| 4,671,735 | A | 6/1987 | Rossmann et al. | |
| 5,264,011 | A | 11/1993 | Brown et al. | |
| 5,520,508 | A | 5/1996 | Khalid | |
| 5,551,840 | A | 9/1996 | Benoit et al. | |
| 5,603,603 | A | 2/1997 | Benoit et al. | |
| 5,704,759 | A | 1/1998 | Draskovich et al. | |
| 5,932,356 | A * | 8/1999 | Sileo et al. | 428/457 |
| 5,997,248 | A | 12/1999 | Ghasripoor et al. | |
| 6,194,086 | B1 | 2/2001 | Nenov et al. | |
| 2001/0014403 | A1 | 8/2001 | Brown et al. | |

FOREIGN PATENT DOCUMENTS

| | | |
|---|---|---|
| DE | 3401 742 A1 | 7/1985 |

(Continued)

*Primary Examiner*—Igor Kershteyn
(74) *Attorney, Agent, or Firm*—Buchanan Ingersoll & Rooney, PC

(57) ABSTRACT

A thermal turbomachine is disclosed having at least one row of rotor blades. At least one first rotor blade has a greater radial length than the others and at the blade tip is equipped with a first abrasive layer. At least one rotor blade which has a shorter radial length than the first rotor blade is equipped with a second abrasive layer at the blade tip. The first abrasive layer has a better cutting capacity and a lower thermal stability than the second abrasive layer. During commissioning of the thermal turbomachine, the first abrasive layer is in contact with the abradable layer of the stator, and during continuous operation of the thermal turbomachine the second abrasive layer is in contact with the abradable layer of the stator.

14 Claims, 4 Drawing Sheets

FOREIGN PATENT DOCUMENTS

| | | | |
|---|---|---|---|
| DE | 35 00 692 | A1 | 7/1986 |
| DE | 44 39 726 | A1 | 5/1996 |
| DE | 198 53 733 | C1 | 11/1998 |
| EP | 0 382 993 | A1 | 8/1990 |
| GB | 2 225 388 | A | 5/1990 |

* cited by examiner

THERMAL TURBOMACHINE

This disclosure is based upon Swiss Application No. 2003 0674/03, filed Apr. 14, 2003, and International Application No. PCT/EP2004/050512, filed Apr. 13, 2004, the contents of which are incorporated by reference herein.

BACKGROUND OF THE INVENTION

1. Field of the Invention

The invention is based on a thermal turbomachine having a rotor, a stator, an abradable layer located on the stator and at least one row of rotor blades which are arranged opposite the stator around the circumference of the rotor.

2. Discussion of Background

The guide veins and rotor blades of gas turbines or compressors are exposed to strong loads. To keep the leakage losses from the thermal turbomachine at a low level, the rotor blade of the turbomachine is matched to the stator in such a manner that a stripping action occurs. A honeycomb structure is arranged at the stator of the gas turbine or compressor, opposite the rotor blade. A compressor having a honeycomb structure of this type is known, for example, from U.S. Pat. No. 5,520,508. The rotor blades of the compressor work their way into this structure, so that a minimal sealing gap is established between the rotor blades and the honeycomb structure. The honeycomb structure consists of a heat-resistant metal alloy. It is composed of a plurality of strips of sheet metal which are bent so as to match the subsequent shape.

The blade tips which abrade into an abradable structure of this type are generally provided with an abrasive layer in order to prevent or at least minimize the wear to or shortening of the rotor blade. U.S. Pat. No. 5,704,759, U.S. Pat. No. 4,589,823 and U.S. Pat. No. 5,603,603 have disclosed, by way of example, turbine blades which are equipped with abrasive materials at the blade tips.

Furthermore, U.S. Pat. No. B1 6,194,086 has disclosed an abrasive protective layer in which cubic boron nitride embedded in a matrix is applied to a turbine blade by means of a plasma spraying process.

It has been found that abrasive layers with very good cutting properties have only a very short service life of as little as just a few hours. However, the base material of the blades is usually somewhat unsuitable to being incorporated without protection in the coating at the stator, since it can melt during the abrasion process and can then be deposited or rubbed onto the stator side. When deposition of the blade material of this nature has occurred, the abrasive system is disrupted and the blades are shortened as the abrasive process continues. In the case of industrial gas turbines, approx. 80% of the abrasion depth which results in the abradable layer of the stator as a result of the rotor blades is reached within the first hours after recommissioning as a result of the abrasion procedure. After the abrasion procedure has been completed, stripping of the veins on the stator is rare, and if it does occur it only involves low penetration depths.

For this reason, it is known from U.S. Pat. No. 4,671,735 and/or DE-A1 34 01 742 for individual blades which, at their end region assigned the casing, are configured in the form of covering strips and the covering-strip-like blade end region of which bears a radially outer wear-resistant layer, to be arranged distributed over the circumference of the rotor. The layer is selected from the group of hard materials.

SUMMARY OF THE INVENTION

The invention is based on the object of providing a thermal turbomachine in which, during commissioning and the abrasion procedure, the rotor blades cut aggressively into the stator material with a considerable penetration depth, whereas the rotor blades subsequently, in commercial operation, only cut or abrade into the stator material to a slight extent over a prolonged operating phase. The intention is to ensure that the abrasive material is able to withstand less forceful contact with the stator without being damaged during this time.

According to the invention, this is achieved in a thermal turbomachine having the features of the independent claim.

A first embodiment of the present invention involves providing a number of first rotor blades which are coated only with a first, aggressively cutting, abrasive layer. The rotor blades which are equipped with the first abrasive layer are longer than all the other rotor blades and are therefore the only ones which have to perform cutting work during contact with the stator.

In addition, further rotor blades, which have only a second abrasive layer, which is more thermally stable, are distributed over the circumference of the rotor. These rotor blades have a shorter radial length than the first rotor blades, which are equipped with the first abrasive layer, and a greater radial length than unreinforced rotor blades. By far the majority of the rotor blades which are distributed over the circumference of the rotor do not have an abrasive layer. However, these rotor blades are protected by the rotor blades with an abrasive layer to the extent that an unreinforced rotor blade does not come into contact with the stator.

In a second embodiment of the present invention, there is a number of first rotor blades having two layers, namely a second abrasive layer and a first abrasive layer, at the blade tip. The top abrasive layer has an aggressive cutting action but only a low thermal stability. The lower abrasive layer, which appears after the upper abrasive layer has worn away, is then less aggressive in terms of its cutting behavior but on the other hand is significantly more thermally stable.

The rotor blades which are provided with the first abrasive layer are longer than all the other rotor blades and are therefore the only ones which have to perform cutting work on contact with the stator. Therefore, during commissioning of the thermal turbomachine and the associated abrasion procedure, only the abrasive layer is in contact with the stator. As operation continues, this upper, aggressively cutting but thermally unstable abrasive layer wears away. Then, in the subsequent commercial phase of the turbomachine, only the second, thermally stable abrasive layer which, however, has a less aggressive cutting action is in contact with the stator.

The abrasive layers preferably consist of very hard cubic boron nitrides with a titanium coating which are embedded in a matrix of filler material. The matrix in which the particles are embedded consists of a relatively ductile material with good wetting properties. The benefit of these coatings consists in the combination of the aggressive cutting behavior produced by the hard materials and the ductility provided by the ductile matrix. The good wetting between titanium coating and compatible filler thereby results in a system which is able to withstand even the strong mechanical loads during the abrasion process. The filler used in the coating of compressor blades is either a steel alloy which is similar to the base material or a nickel material with small added amounts of Bi and S. For components from the turbine stage in which higher temperatures prevail, it is likewise possible to use suitable superalloys based on nickel or cobalt.

Further advantageous configurations of the invention will emerge from the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only those elements which are pertinent to gaining an understanding of the invention are shown. Like reference numerals designate identical or corresponding parts throughout the several views. The direction of flow of the media is indicated by arrows.

DESCRIPTION OF THE PREFERRED EMBODIMENTS

Figure 1:
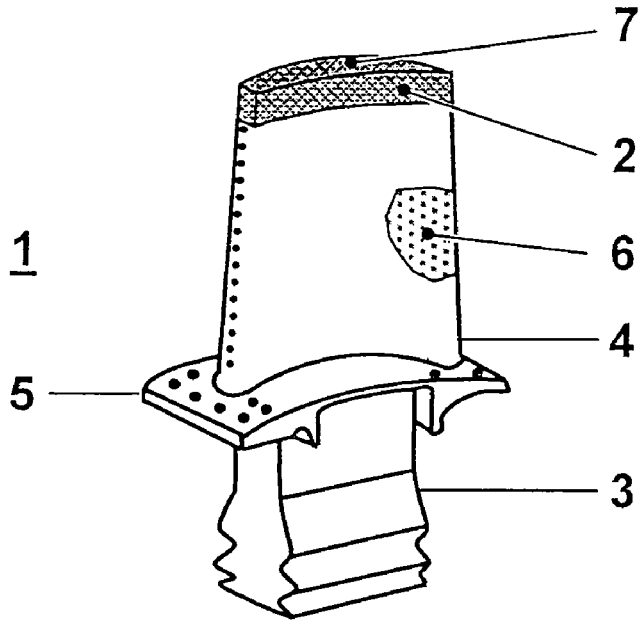
FIG. 1 shows a turbine blade according to the invention with an abrasive protective layer at the tip.

Referring now to the drawings, FIG. 1 shows a rotor blade 1 of a gas turbine, a compressor or some other thermal turbomachine. The rotor blade 1 comprises a main blade part 4 having a blade tip 2 and a blade root 3, by means of which the rotor blade 1 is mounted on a rotor 9. A platform 5, which protects the blade root 3 and therefore the rotor 9 from the fluids flowing around the main blade part 4, is usually arranged between the main blade part 4 and the blade root 3. The rotor blade 1 may be coated with a protective layer 6 of MCrAlY and additional ceramic material (TBC). An abrasive protective layer 7 is arranged at the tip of this rotor blade 1.

Figure 2:
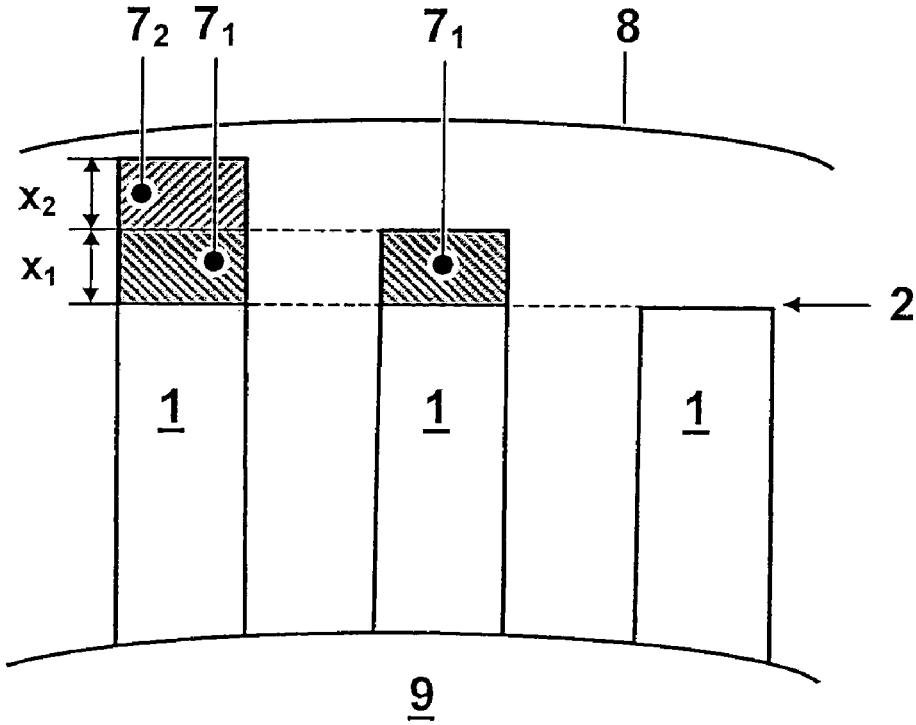
FIG. 2 shows a rotor of a turbomachine according to the invention with a number of rotor blades which are arranged opposite a stator.
Figure 3:
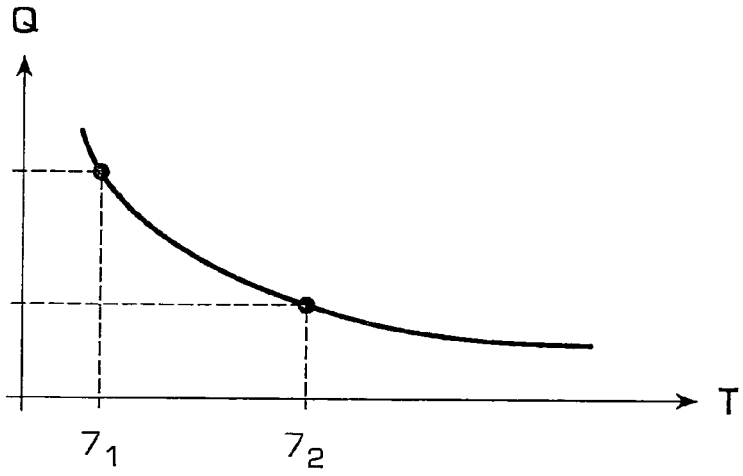
FIG. 3 shows a diagram plotting the quality Q of the cutting capacity against the thermal stability T of the various abrasive protective layers.

FIG. 2 shows an excerpt from a row of rotor blades belonging to the thermal turbomachine. The rotor blades 1 are secured to the rotor 9 and arranged opposite the stator 8. According to the invention, a small number of the rotor blades 1 belonging to a row of rotor blades arranged over the circumference of the rotor 9 are equipped with two different abrasive layers $\mathbf{7}_1$, $\mathbf{7}_2$ at the blade tip 2. The top abrasive layer $\mathbf{7}_2$ of height $x_2$ has an aggressive cutting action but only a low thermal stability. The lower abrasive layer $\mathbf{7}_1$ of height $x_1$, which appears after the upper abrasive layer $\mathbf{7}_2$ has worn away, is less aggressive in terms of its cutting properties but significantly more thermally stable. The qualitative relationship between the quality of the cutting capacity Q and the thermal stability T of the abrasive layers $\mathbf{7}_1$, $\mathbf{7}_2$ is diagrammatically depicted in FIG. 3.

The rotor blades 1 which are provided with the abrasive layer $\mathbf{7}_2$ are longer than all the other rotor blades 1 and are therefore the only ones which have to perform cutting work on contact with the stator 8. Therefore, during (re)commissioning of the thermal turbomachine and the associated abrasion procedure, only the abrasive layer $\mathbf{7}_2$ is in contact with the stator 8. During further operation, this upper, aggressively cutting but thermally unstable abrasive layer $\mathbf{7}_2$ wears away. Then, in the subsequent commercial phase of the turbomachine, only the lower abrasive layer $\mathbf{7}_1$ is in contact with the stator 8.

A simple variant of the present invention consists in using rotor blades 1 of three different lengths in a row of blades. A number of first rotor blades 1 are coated only with a first, aggressively cutting abrasive layer $\mathbf{7}_2$. The rotor blades 1 which are equipped with the first abrasive layer $\mathbf{7}_2$ are longer than all the other rotor blades 1 and are therefore the only ones which have to perform cutting work on contact with the stator 8.

On account of the relatively poor thermal stability of the abrasive layer $\mathbf{7}_2$, rotor blades 1 which have only a lower abrasive layer $\mathbf{7}_1$, with less good cutting properties but a significantly greater thermal stability, are additionally distributed over the circumference of the rotor 9. As illustrated in FIG. 2, these rotor blades 1 are of a shorter radial length than the first rotor blades 1 which are equipped with the first or upper abrasive layer $\mathbf{7}_2$ and a greater radial length than unreinforced rotor blades 1.

By far the majority of the rotor blades 1 which are distributed over the circumference of the rotor 9 do not have an abrasive layer. However, these rotor blades 1 are protected by the rotor blades 1 having an abrasive layer $\mathbf{7}_1$, $\mathbf{7}_2$ to a sufficient extent for an unreinforced rotor blade 1 not to come into contact with the stator 8, since these blades are of a shorter radial length.

Figure 4:
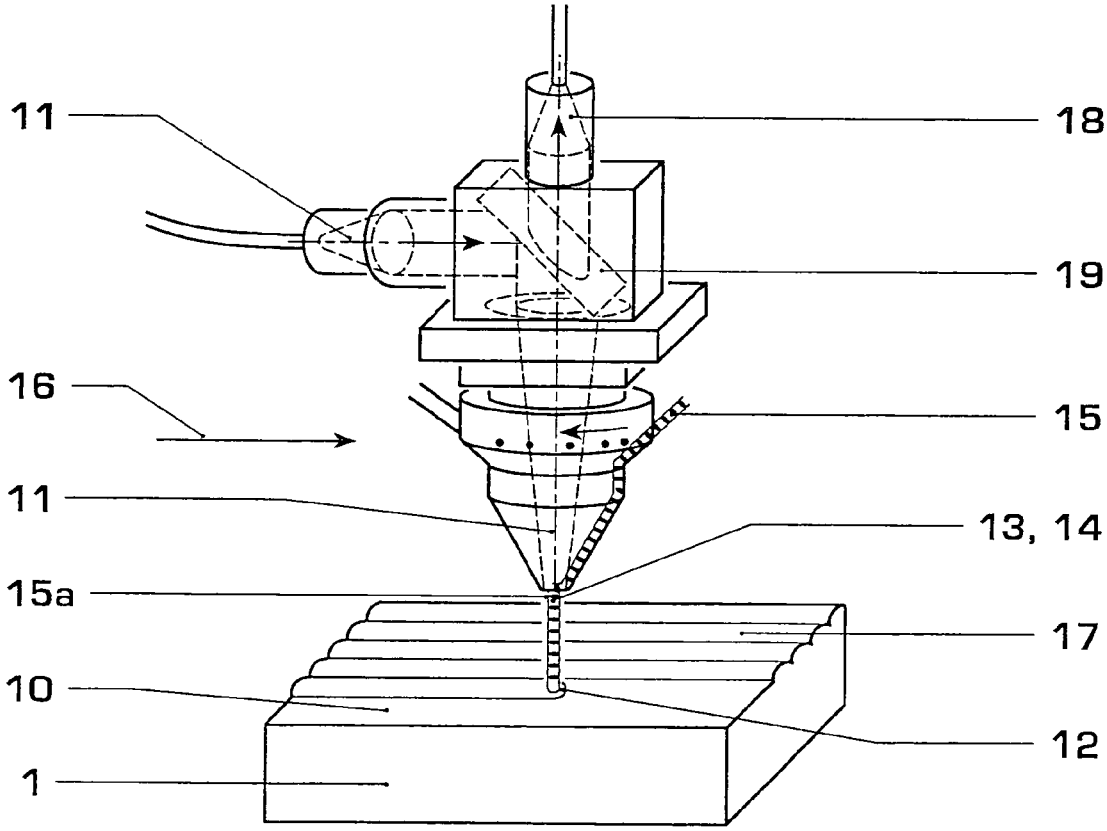
FIG. 4 shows a device for coating a turbine blade.
Figure 5:
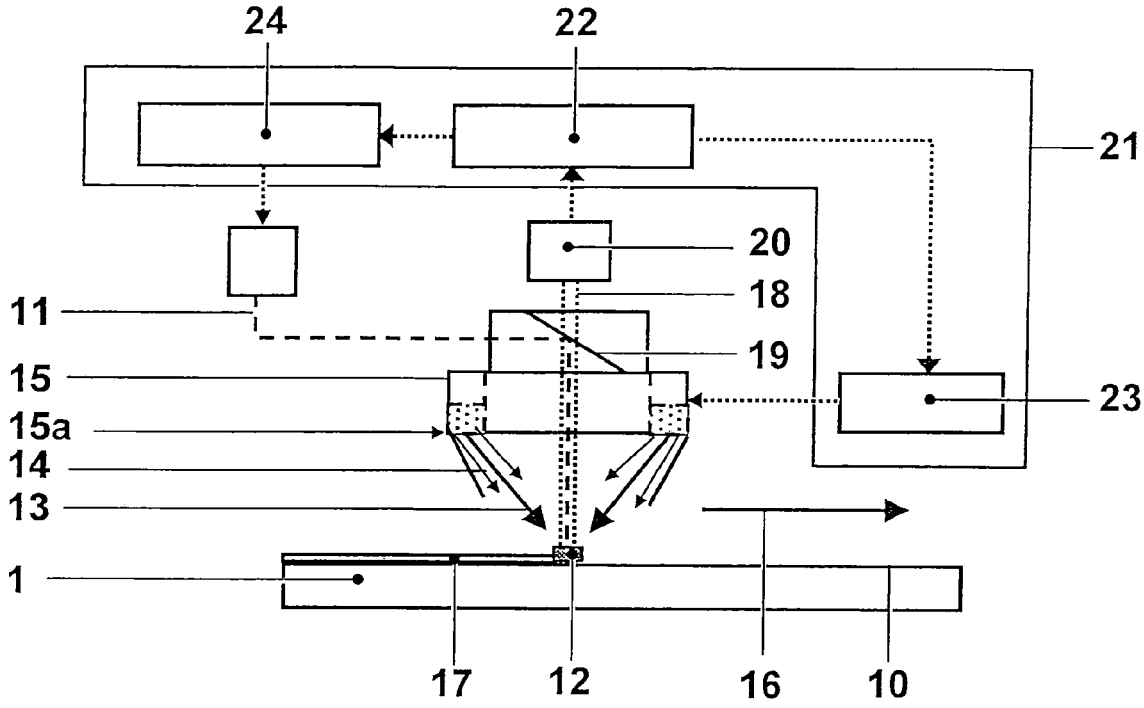
FIG. 5 shows a control system for the device shown in FIG. 4.
Figure 6:
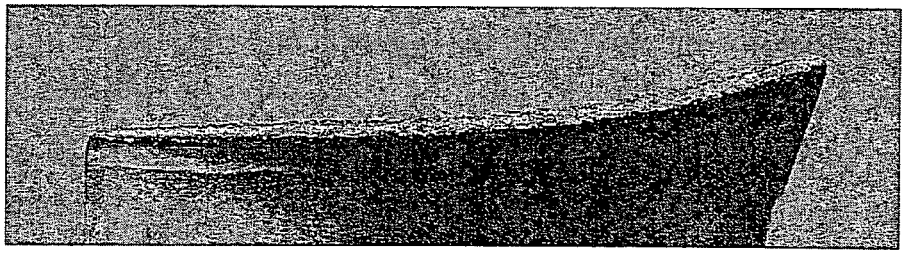
FIG. 6 shows a compressor blade tip which has been produced by the invention and has an abrasive protective layer.

FIGS. 4 and 5 diagrammatically depict a device and a process for applying an abrasive layer $\mathbf{7}_1$, $\mathbf{7}_2$ to the tip of a rotor blade 1. A process of this type is known, for example, from DE-C1 198 53 733.

The first abrasive layer $\mathbf{7}_2$ preferably consists of very hard cubic boron nitrides (cBN), while the second abrasive layer $\mathbf{7}_1$ consists of carbides, in particular of chromium carbides, in each case embedded in a matrix of filler material. The matrix in which the particles are embedded consists of relatively ductile material with good wetting properties, and the wetting of the abrasive particles can be increased by a titanium or nickel coating. The benefit of these coatings consists in the combination of the aggressive cutting behavior produced by the hard materials with the ductility provided by the ductile matrix. The good wetting between titanium coating and compatible filler thereby results in a system which is able to withstand even the strong mechanical loads which occur during the abrasion process. The filler used for the coating of compressor blades is either a steel alloy which is similar to the base material or a nickel material with small added amounts of Bi and S. For components from the turbine stage in which higher temperatures prevail, it is likewise possible to use suitable superalloys based on nickel or cobalt.

FIG. 4 shows a general example of a device used to apply a coating 17, which corresponds to the abrasive layer $\mathbf{7}_1$, $\mathbf{7}_2$, to the blade tip 2 of a rotor blade 1. A laser beam 11 is moved over the surface 10 of the rotor blade 1 (or alternatively the rotor blade 1 is moved relative to the laser beam 11), so that the surface 10 is locally melted. In the process, a melt pool 12 is formed. Pulverulent material 13 and a carrier gas 14 are fed to the melt pool 12 by means of a feed nozzle 15 and a nozzle 15*a* in the form of a jet for the purpose of the coating or other application methods. The pulverulent material may be a suitable mixture of abrasive hard material and binder material. An optical signal 18 is continuously recorded for the melt pool 12 and used to determine the temperature, temperature fluctuations and gradients as properties of the melt pool 12. The present device and the corresponding process can also be used to successively apply a plurality of coatings 17, in which case the process parameters, such as for example laser power, rate of advance or mixing ratio between hard material and binder material can be altered for each coating 17 or for different parts of the same coating 17. The present process is also suitable for the coating of three-dimensional objects. In the embodiment shown in FIG. 4, the powder 13 is added to the melt pool 12 concentrically with respect to the cone of the optical signals 18 recorded from the melt pool 12.

FIG. 5 shows an overall controller 21 for the device shown in FIG. 4. The information provided by the optical signal 18 is used in a closed-loop control circuit in the controller 21 in order to adjust process parameters, such as laser power, the relative velocity between the laser beam 11 and the component to be coated, the volumetric flow of carrier gas 14, the mass flow of the injected powder 13, the distance between the nozzle 15*a* and the rotor blade 1 and the angle between the nozzle 15*a* and the rotor blade 1. A controller 24 is used to control the laser power, and a controller 23 inside the controller 21 is used to control the feed nozzle 15. In this way, it is possible to achieve the desired properties of the melt pool 12. As indicated by reference numeral 17 in FIG. 5, the melt pool 12 then solidifies as a coating.

The automatic control of the laser power by the controller 21 makes it possible to set a temperature field which is advantageous with a view to achieving the desired microstructure of the coating 17. In addition, the optical signal 18 can be used to avoid Marangoni convection in the melt pool 12. This minimizes the risk of defects being formed during solidification of the molten material.

High-performance lasers, such as $CO_2$, fiber-coupled Nd-YAG or diode lasers are particularly suitable for use as the energy source. The laser radiation can be focused onto small spots and varied, allowing very accurate control of the introduction of energy into the base material. As can be seen from FIG. 5, the controller 24 for the laser power is decoupled from the main process controller 22. This allows more rapid processing of the data in real time. The present process uses a concentric feed nozzle 15, a laser 11 and an online monitoring system with real-time process control. This online monitoring system can be used to set optimum process parameters in order thereby to obtain a desired microstructure of the coating 17.

As can be seen from FIG. 4, the process combines the supply of laser beam and material and the monitoring system in a common head. The infrared (IR) radiation of the melt pool 12 can be recorded by the same optics used for the laser beam with the aid of a dichroic mirror 19. The dichroic mirror 19 transmits the laser beam 11 to the melt pool 12 and simultaneously transmits the optical signal 18 from the melt pool 12. The-optical signal 18 is transmitted from the melt pool 12 to a pyrometer 20 or other detector in order for the online determination of the temperature of the melt pool 12 to be performed.

For these purposes, the optical properties of the monitoring system are selected in such a way that the measurement spot is smaller than the melt pool 12 and is located in the center of the melt pool.

FIG. 2 shows an example of a coated compressor blade tip which has been produced using the process described. It can be seen that the coated component is a thin-walled structure which would be deformed in the event of excessive heat being introduced, which would lead to unacceptable tolerances. The locally very limited action of the laser and the precise power control avoids this and means that the dimensions of the component are only altered minimally.

Figure 7:
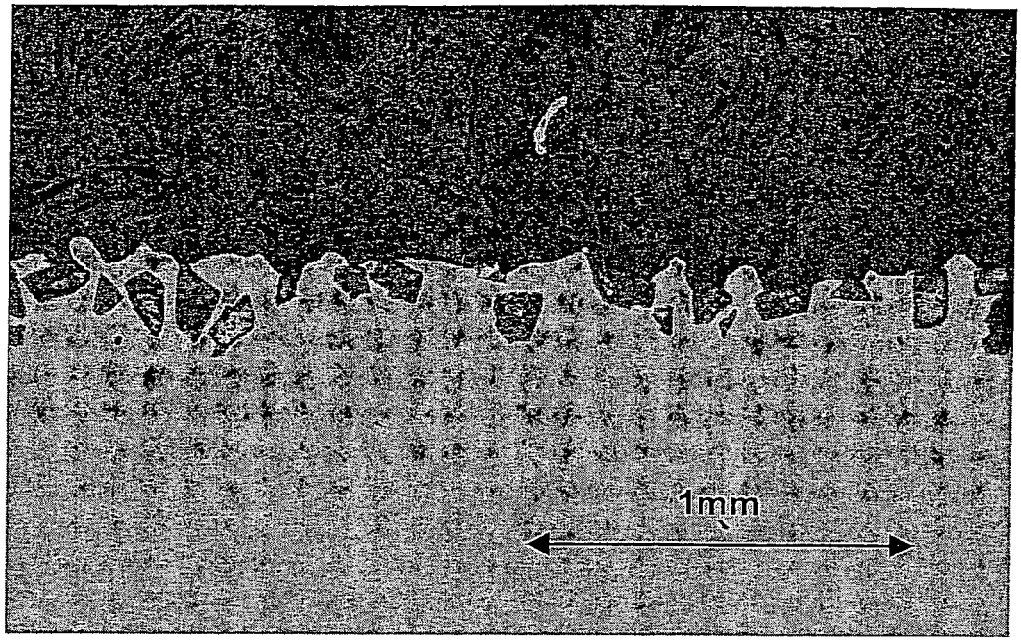
FIG. 7 shows a microsection through an abrasive coating.

FIG. 7 shows a longitudinal microsection through a compressor blade tip which has been provided with an abrasive coating. The base material of the blade consists of austenitic steel, and the coating, which is approximately 300 μm thick; was produced from a mixture of Ti-coated cBN hard-material particles and NiBSi binder material. This is an example in which only a single coating has been applied. The cBN hard-material particles can be seen as block structures in the top half of the coating. They are completely surrounded by binder material, which is evidence of the good wetting of the hard-material particles. FIG. 7 shows that with good process control, for example by means of the controller which has already been described in FIG. 5, it is possible to achieve a crack-free and pore-free structure with excellent attachment to the base material.

In a further embodiment of the present invention, the optical signal 18 used for power control is recorded from the center and edge regions of the melt pool by means of a fiber-optic image conductor or a CCD camera. For this purpose, the CCD camera used as a detector is equipped with suitable optical filters. This information is then used to determine the temperature at one point or a plurality of points simultaneously in the center or edge region of the melt pool 12. The cone of the recorded optical signal 18 can in this case be arranged concentrically with respect to the focussed laser beam. This symmetrical arrangement ensures that the interaction processes between laser and powder 13 are identical for all directions of movement. This is advantageous in particular for the processing of components of complex shapes, since the constant interaction processes result in a uniformly good processing quality. In another embodiment of the invention, the optical signal 18 emitted from the melt pool 12 is used for quality control: the analysis of the measured values allows the process parameters to be optimized in such a way that a desired microstructure of the coating results. The recording of the signals can also be effected for documentation purposes and to ensure a constant product quality. Specifically designed, commercially available software tools (e.g. LabView RT) with extensive functionality can be used to realize the control system. This makes it possible to achieve control times of <10 ms. Moreover, complex PID controls with parameters which are specifically matched to the particular temperature range can be implemented for the control system.

Obviously, numerous modifications and variations of the present invention are possible in light of the above teachings. It is therefore to be understood that within the scope of the appended claims, the invention may be practiced otherwise than as specifically described herein.

LIST OF DESIGNATIONS

1 Rotor blade
2 Blade tip
3 Blade root
4 Main blade part
5 Platform
6 Protective layer
7 Abrasive protective layer
$\mathbf{7}_1$ First abrasive protective layer
$\mathbf{7}_2$ Second abrasive protective layer
8 Stator
9 Rotor
10 Surface of the turbine blade 1
11 Laser beam
12 Melt pool
13 Powder, pulverulent material
14 Carrier gas
15 Feed nozzle

15*a* Nozzle
16 Direction of movement
17 Solidified material, coating
18 Optical signal
19 Dichroic mirror
20 Pyrometer
21 Controller
22 Main process controller
23 Controller for feed nozzle 15 and nozzle 15*a*
24 Controller for laser 11
Q Quality of the cutting performance
T Thermal stability
$x_1$ Height of the abrasive protective layer $\mathbf{7}_1$
$x_2$ Height of the abrasive protective layer $\mathbf{7}_2$

The invention claimed is:

1. A thermal turbomachine comprising a rotor and a stator, at least a region of the inner perimeter of the stator being coated with an abradable layer, and at least one row of rotor blades being arranged over the perimeter of the rotor with blade tips facing the coated region of the stator, at least one first rotor blade having a greater radial extend than second rotor blades and being equipped at the blade tip with a first abrasive layer, at least one second rotor blade having a smaller radial extend than the first rotor blade being equipped at the blade tip with a second abrasive layer, the first abrasive layer having a higher abrasion capacity and thus a more aggressive abrasion behavior against the abradable layer and a lower thermal stability than the second abrasive layer.

2. The thermal turbomachine as claimed in claim 1, wherein a second abradable layer being arranged on the blade tip of at least one rotor blade, and a first abradable layer being arranged on the second abradable layer.

3. The thermal turbomachine as claimed in claim 1, wherein a number of first and second rotor blades are arranged over the perimeter of the row of rotor blades on the rotor.

4. The thermal turbomachine as claimed in claim 3, comprising third rotor blades having a smaller radial length than the first and second rotor blades and having uncoated blade tips.

5. The thermal turbomachine as claimed in claim 1, wherein the abrasive layers comprise abrasive particles embedded in a matrix.

6. The thermal turbomachine as claimed in claim 5, wherein in the first abrasive layer the particles are cubic boron nitrides and in the second abrasive layer the particles are carbides.

7. The thermal turbomachine as claimed in claim 5, wherein the particles of the first layer, the second layer, or both, are coated with a coating selected from the group consisting of a nickel alloy and a titanium alloy.

8. The thermal turbomachine as claimed in claim 5, wherein the matrix consists of one selected from the group consisting of a component-similar steel alloy similar to that of the blade, a highly thermally stable nickel solder compound, and a highly thermally stable nickel or cobalt superalloy.

9. A method for producing a blade of a thermal turbomachine as claimed in claim 5, comprising melting the blade material at the blade tip, and adding a pulverulent material to the melt pool thus formed.

10. The method as claimed in claim 9, wherein the pulverulent material comprises abrasive hard material particles and binder material.

11. The method as claimed in claim 9, further comprising the use of a laser beam to melt the material at the blade tip.

12. The method as claimed in claim 9, wherein utilizing active laser power control in order to prevent sublimation or dissolution of the abrasive particles.

13. The thermal turbomachine as claimed in claim 1, wherein the thermal turbomachine is a compressor or gas turbine.

14. The thermal turbomachine as claimed in claim 6, wherein in the second abrasive layer the particles are chromium carbides.

* * * * *